US010800023B1

(12) United States Patent
Ferris

(10) Patent No.: US 10,800,023 B1
(45) Date of Patent: Oct. 13, 2020

(54) COLLAPSIBLE BREACHING TOOL

(71) Applicant: Breaching Technologies, Inc., San Antonio, TX (US)

(72) Inventor: Mark Ferris, San Antonio, TX (US)

(73) Assignee: Breaching Technologies, Inc., San Antonio, TX (US)

( * ) Notice: Subject to any disclaimer, the term of this patent is extended or adjusted under 35 U.S.C. 154(b) by 0 days.

(21) Appl. No.: 16/035,289

(22) Filed: Jul. 13, 2018

Related U.S. Application Data

(63) Continuation of application No. 15/016,597, filed on Feb. 5, 2016, now Pat. No. 10,058,991.

(60) Provisional application No. 62/140,421, filed on Mar. 30, 2015.

(51) Int. Cl.

| | |
|---|---|
| ***B25G 1/04*** | (2006.01) |
| ***B25D 1/00*** | (2006.01) |
| ***A62B 3/00*** | (2006.01) |

(52) U.S. Cl.
CPC ..... *B25G 1/04* (2013.01); *A62B 3/005* (2013.01); *B25D 1/00* (2013.01)

(58) Field of Classification Search
CPC .. B25G 1/04; B25G 3/30; B25G 1/043; A62B 3/005; B25D 1/00
See application file for complete search history.

(56) References Cited

U.S. PATENT DOCUMENTS

| | | | | |
|---|---|---|---|---|
| 5,996,442 A * | 12/1999 | Carmien | ..... | B25D 1/02 294/53.5 |
| 6,182,539 B1 * | 2/2001 | Webster | ..... | B25B 23/0021 81/177.2 |
| 8,220,852 B2 * | 7/2012 | Fenstemaker | ..... | B25F 1/02 294/51 |

* cited by examiner

*Primary Examiner* — Monica S Carter
*Assistant Examiner* — Abbie E Quann
(74) *Attorney, Agent, or Firm* — Edward B. Marvin; Gunn, Lee & Cave, P.C.

(57) ABSTRACT

A collapsible breaching tool comprising a tool head; a handle hold connected to the tool head and having outer thread; a first handle tube having a first end, a second end, and defining a first handle tube volume; a second handle tube having a length, the second handle tube moveable between a first position in which most of the length is outside the first handle tube volume and a second position in which most of the length is within the first handle tube volume; an insert connected to the second handle tube, the insert having an inner thread engageable with the outer thread of the handle hold.

20 Claims, 6 Drawing Sheets

COLLAPSIBLE BREACHING TOOL

CROSS REFERENCE TO RELATED APPLICATIONS

This continuation application claims priority to and the benefit of U.S. patent application Ser. No. 15/016,597, filed on Feb. 5, 2016, which claims priority to and the benefit of U.S. provisional application Ser. No. 62/140,421, filed Mar. 30, 2015, both of which are incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to tool for effecting forced entry of a building. More specifically, the invention relates to a breaching tool that is collapsible and expandable between an easily-transportable compressed state and an extended state for breaching a door, respectively.

2. Description of the Related Art

Both public-safety and military personnel are often faced with the need to perform a forced entry into structures. A forced entry can be, and often is, a life-threatening scenario during which every second counts. Shaving seconds from the operation can mean the difference between life-saving tactical surprise and life-ending ambush. Knowledge of and training with the variations in door-breaching techniques, however slight, as well as practice and conditioning for the door breaching operation, are vital to a tactical situation.

Breaching tools have been used throughout the ages for penetrating fortified positions. Breaching tools are commonly used today by the military, law enforcement, firefighters, emergency response workers, and other public safety personnel to effect forced entry into a building or structure. Typical breaching tools, however, are unwieldy and cumbersome. U.S. Pat. No. 4,681,171 (the '171 patent), for example, discloses a typical battering ram that includes a bulky, concrete-filled cylinder with an epoxy resin head. The battering ram disclosed in the '171 patent, however, is physically difficult to pack due to both its bulky design and its weight.

The inability of traditional, cumbersome breaching tools to be comfortably carried or packed has often lead soldiers, law enforcement officers, and other such public safety personnel to jettison the devices if the likelihood of use is low. Should such a device later be needed, the soldier must instead implement improvised methods of entry, such as shooting through the door or using explosives. Such improvised methods are dangerous for the user, and also increase the possibility of collateral damage to whomever or whatever is on the other side of the door.

BRIEF SUMMARY OF THE INVENTION

The present invention is a collapsible breaching tool that can be expanded to a first configuration for breaching and compressed to a second configuration for transport or storage. The tool comprises a tool head; a handle hold connected to the tool head, the handle hold having an outer thread; a first handle tube having a first end, a second end, and defining a first handle tube volume; a second handle tube having a length, the second handle tube moveable between a first position in which most of the length is outside the first handle tube volume and a second position in which most of the length is within the first handle tube volume; an insert connected to the second handle tube, the insert having an inner thread engageable with the outer thread of the handle hold.

DETAILED DESCRIPTION OF THE VARIOUS EMBODIMENTS

Figure 1:
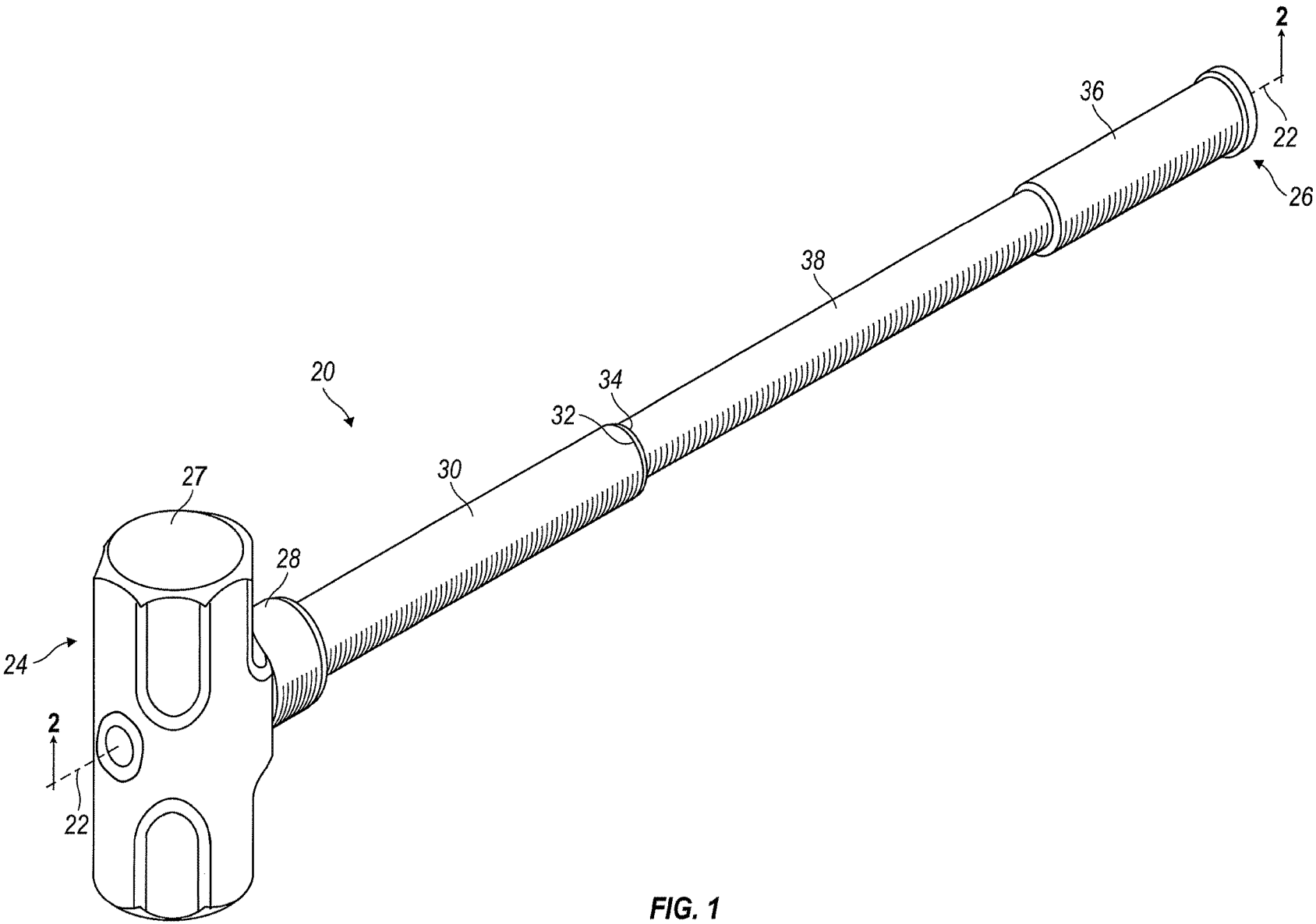
FIG. 1 is an isometric view of an embodiment of the present invention in an expanded, or breaching, state.

Referring to FIG. 1, an embodiment 20 of the invention is oriented along a longitudinal axis 22 and has a first end 24 and a second end 26. The embodiment 20 includes a sledge hammer head 27 connected to a taper lock nut 28. The taper lock nut 28 partially surrounds a first handle tube 30 with an end 32. The end 32 partially surrounds a female insert 34. A knurled handle 36 partially surrounds a second handle tube 38.

Figure 2:
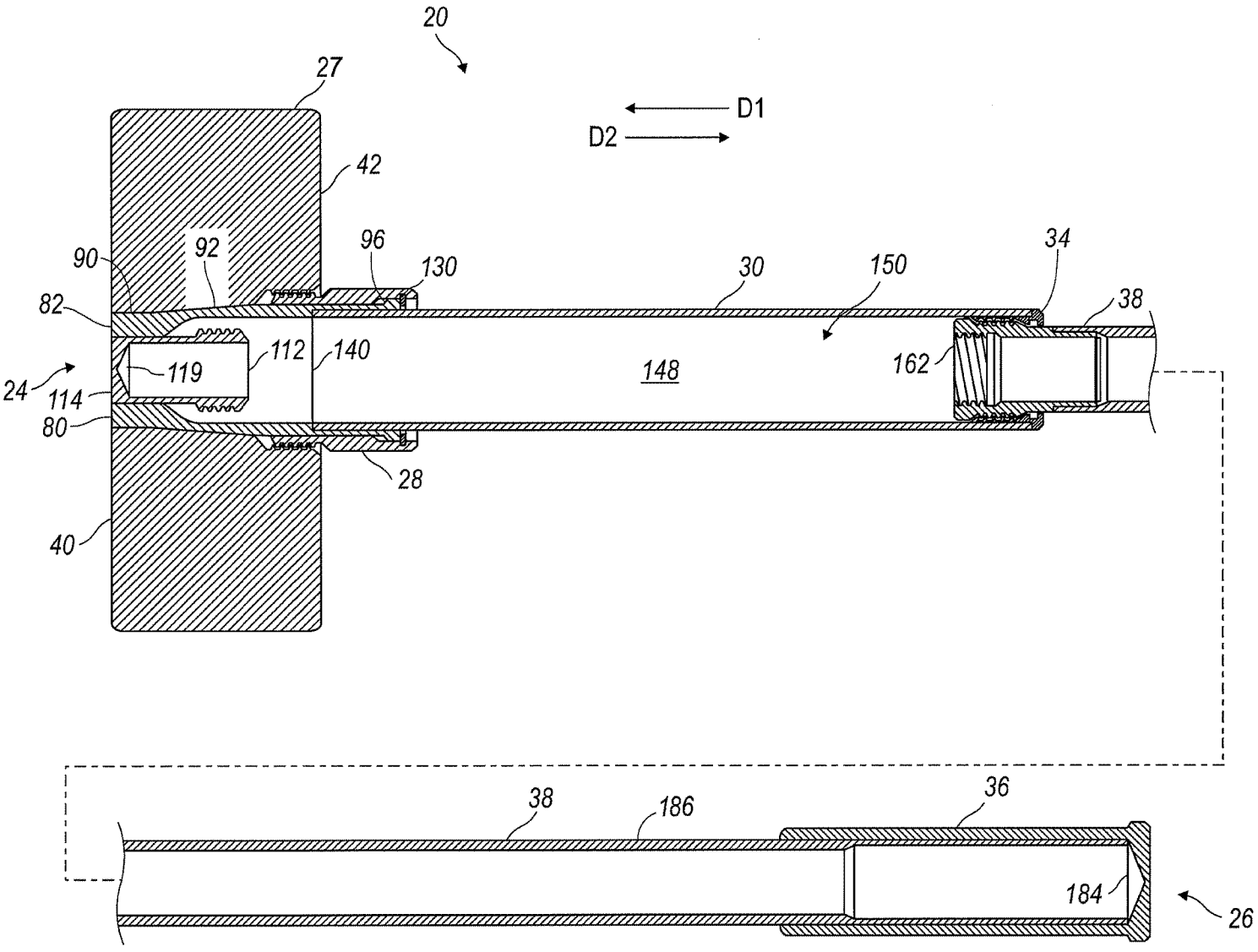
FIG. 2 is side sectional view of the embodiment through plane 2-2 of FIG. 1.
Figure 3:
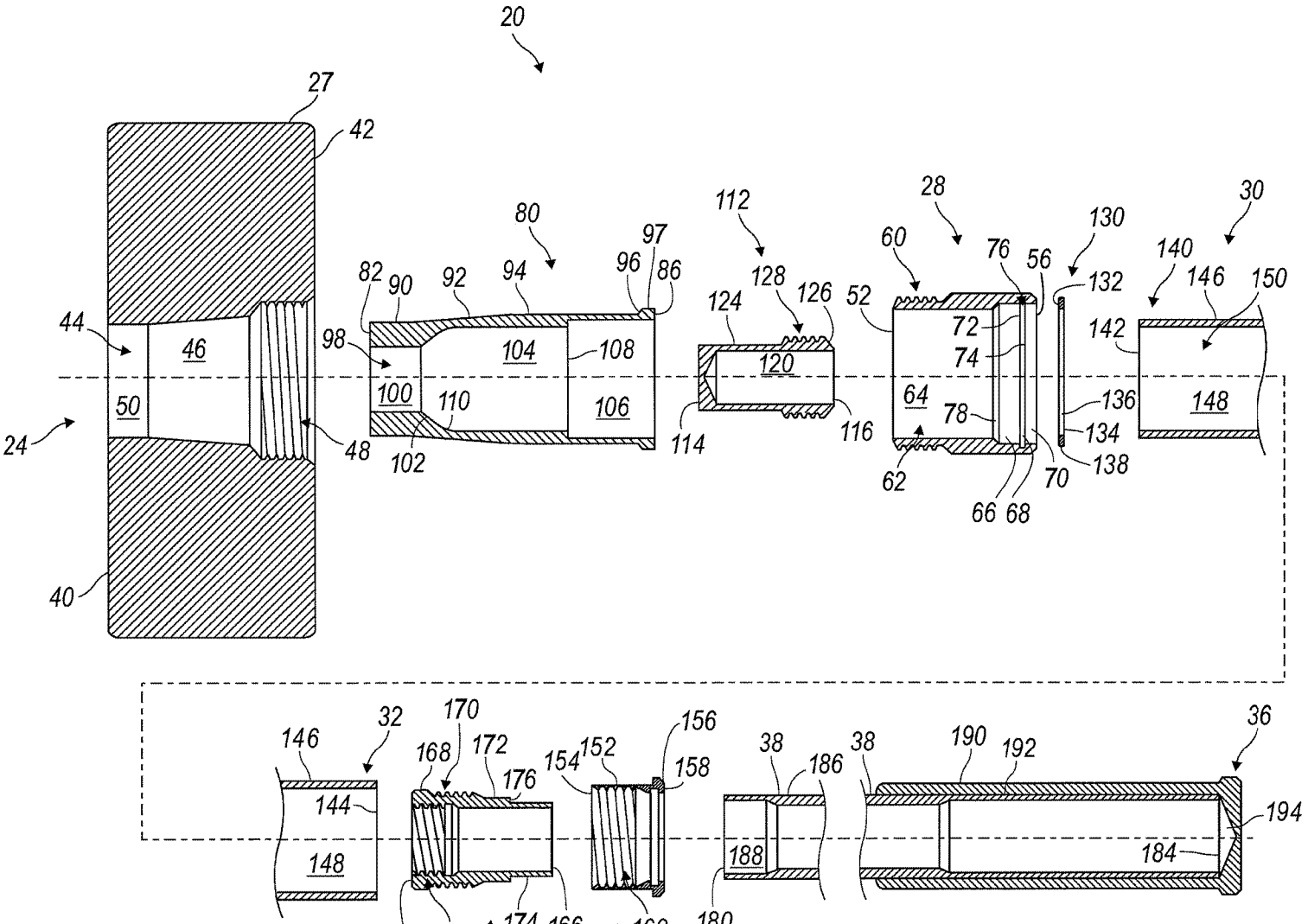
FIG. 3 is a side sectional assembly view of the embodiment shown in FIG. 2.

Referring jointly to FIGS. 2-3, the hammer head 27 has a first side 40 coterminal with the first end 24 and an opposing second side 42. A passage 44 extends between the first side 40 and the second side 42. The passage 44 is defined by a partially-conical surface 46, a threaded section 48, and a non-cylindrical surface 50. The threaded section 48 has an inner diameter greater than the maximum diameter of the partially-conical section 46.

The taper lock nut 28 is a solid metallic tubular body threaded to the threaded section 48 of the hammer head 27. The nut 28 has a first annular surface 52 that defines a first opening having a first diameter and a second annular surface 56 that defines a second opening having a second diameter. An outwardly-threaded section 60 is engageable with the threaded section 48 of the head 27. A second passage 62 is defined by a first inner cylindrical surface 64, a second inner cylindrical surface 66, a third inner cylindrical surface 68, and a fourth inner cylindrical surface 70. First and second inner annular surfaces 72, 74 are adjacent to the third cylindrical surface 68 and define a toroidal groove 76. A partially conical surface 78 is adjacent to, and longitudinally between, the first and second inner cylindrical surfaces 64, 66.

A taper lock adaptor 80 occupies the passage 44. The adaptor 80 is a solid tubular body that includes a first non-cylindrical annular surface 82 defining a first opening and an opposing annular surface 86 defining a second opening. A first outer non-cylindrical surface 90 is adjacent to the first annular surface 82. A first partially-conical outer surface 92 is adjacent the first outer non-cylindrical surface 90. The first partially-conical surface 92 has a maximum and minimum diameter slightly less than maximum and minimum diameters, respectively, of the partially conical inner surface 46. A second outer cylindrical surface 94 is adjacent to the partially-conical surface 92. A second partially-conical surface 96 is adjacent to the second cylindrical surface 94. A third cylindrical surface 97 is adjacent to the second partially-conical surface 96 and has an outer diameter slightly less than the inner diameter of the third inner cylindrical surface 68.

A third passage 98 is defined by a first inner cylindrical surface 100, a first partially-conical inner surface 102 adjacent to the first inner cylindrical surface 100, a second partially-conical surface 104, and a second inner cylindrical surface 106. An inner annular surface 108 is adjacent to the second partially-conical surface 104 and the second inner cylindrical surface 106. A curved surface 110 is adjacent to, and longitudinally between, the first and second partially conical surfaces 102, 104.

A handle hold 112 is connected to the taper lock adaptor 80. The hold 112 is a single metallic body that has a circular end surface 114 and an opposing annular end surface 116 defining an opening. A cylindrical inner surface 120 is adjacent to the annular surface 116. A conical surface 119 is adjacent to the cylindrical inner surface 120. A cylindrical outer surface 124 is adjacent to the end surface 114 and has a diameter slightly less than the first inner cylindrical surface 100 of the taper lock adaptor 80. A partially conical outer surface 126 is adjacent to the annular end surface 116. An outer thread 128 is longitudinally positioned between the cylindrical surface 124 and the partially conical surface 126.

A retaining ring 130 occupies the groove 76. The ring 130 has first and second annular surfaces 132, 134, an inner cylindrical surface 136, and an outer cylindrical surface 138.

The first handle tube 30 has a first end 140 radially within the taper lock adaptor 80 and the opposing second end 32. The first end 140 includes a first annular surface 142 in contact with the annular surface 108 of the taper lock adaptor 80. The second end 32 includes a second annular surface 144. An outer cylindrical surface 146 extends between, and is adjacent to, the first and second annular surfaces 142, 144. The outer cylindrical surface 146 has a diameter less than the inner cylindrical surface 136 of the retaining ring 130 and the second inner cylindrical surface 106 of the taper lock adaptor 80. An inner cylindrical surface 148 extends between, and is adjacent to, the first and second annular surfaces 142, 144 and defines a cylindrical handle interior 150.

The female insert 34 is a metallic tubular body that partially occupies the handle interior 150. The insert 34 has a first outer cylindrical surface 152 with a diameter slightly less than the diameter of the inner cylindrical surface 148 of the first handle tube 30. The insert 34 has a first annular end surface 154 within the interior 150, a partially-conical surface 156, and a second annular end surface 158. The insert 34 has an internally-threaded passage 160.

The embodiment 20 further includes a male insert 162 that is a metallic tubular body partially occupying part of the handle interior 150 and the internally-threaded passage 160. The male insert 162 has a first annular surface 164, an opposing second annular surface 166, and a first outer cylindrical surface 168 having an outer diameter greater than the inner diameter of the first annular surface 154 of the of the female insert 34. The male insert 162 has an outer thread 170 engageable with the inner thread 160 of the female insert 34, and a second outer cylindrical surface 172 longitudinally between the outer thread 170 and the second annular surface 166. The male insert 162 includes a third outer cylindrical surface 174 adjacent to the second annular surface 166 and an intermediate annular surface 176 adjacent to the second and third outer cylindrical surfaces 172, 174. The male insert 162 includes an inner thread 178 engageable with the outer thread 128 of the handle hold 112.

The second handle tube 38 is connected to the male insert 162. The second handle tube 38 is a generally tubular body having a first annular end surface 180 defining a first opening and an opposing second annular end surface 184. The first annular end surface 180 abuts the intermediate annular surface 176 of the male insert 162. A cylindrical outer surface 186 extends between, and is adjacent to, the first and second annular surfaces 180, 184. A first inner cylindrical surface 188 is adjacent to the first annular surface 180 and has a diameter slightly larger than the diameter of the third outer cylindrical surface 174 of the male insert 162.

The handle 36 is connected to the second handle tube 38. The handle 36 has a knurled outer surface 190 and a cylindrical inner surface 192. A conical inner surface 194 is adjacent to the cylindrical inner surface 192.

FIG. 2 shows the embodiment 20 in the expanded state. Longitudinal movement of the lock adaptor 80 in a first direction D1 is inhibited by contact of the partially-conical outer surface 92 of the lock adaptor 80 with the partially-conical inner surface 46 of the head 27. Longitudinal movement of the lock adaptor 80 in an opposite second direction D2 is inhibited by contact of the annular end surface 86 with the retaining ring 130.

Figure 4:
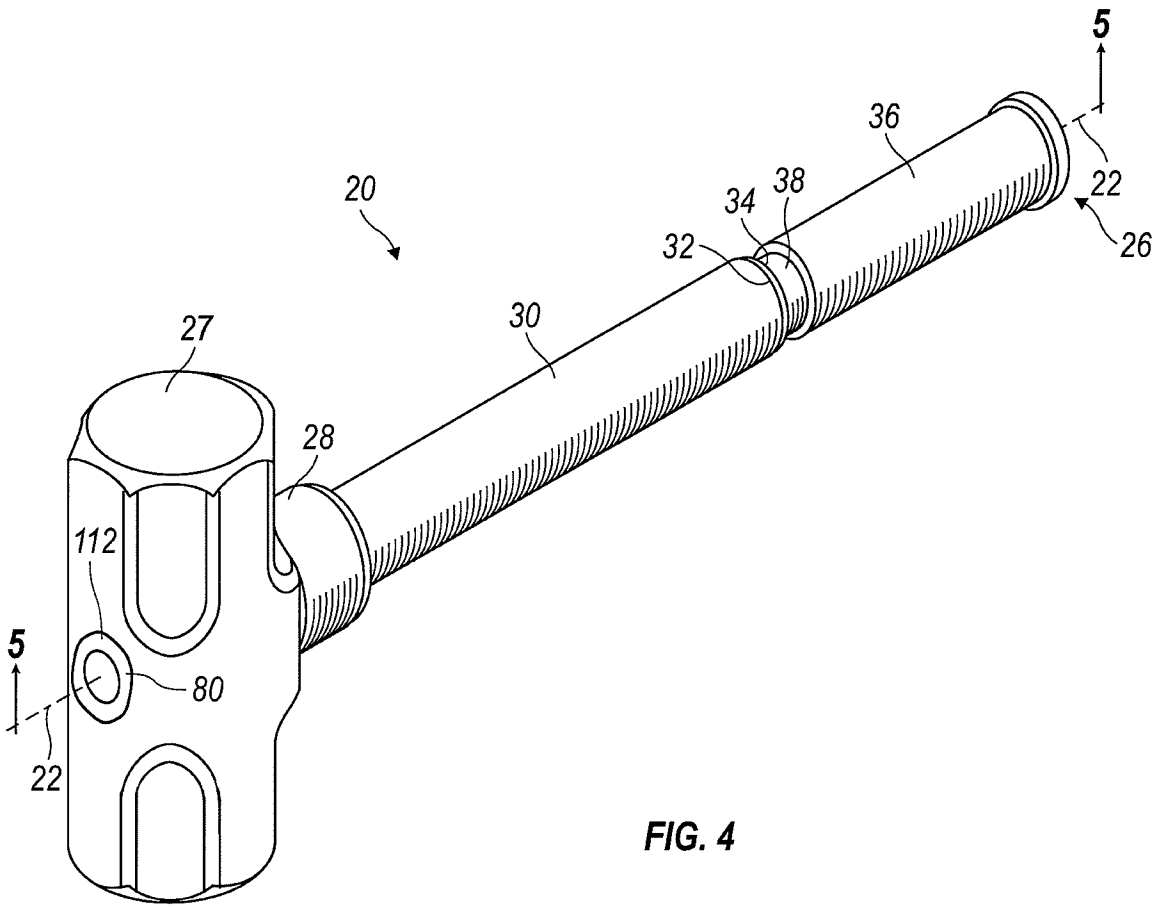
FIG. 4 is an isometric view of the embodiment in a retracted state.
Figure 5:
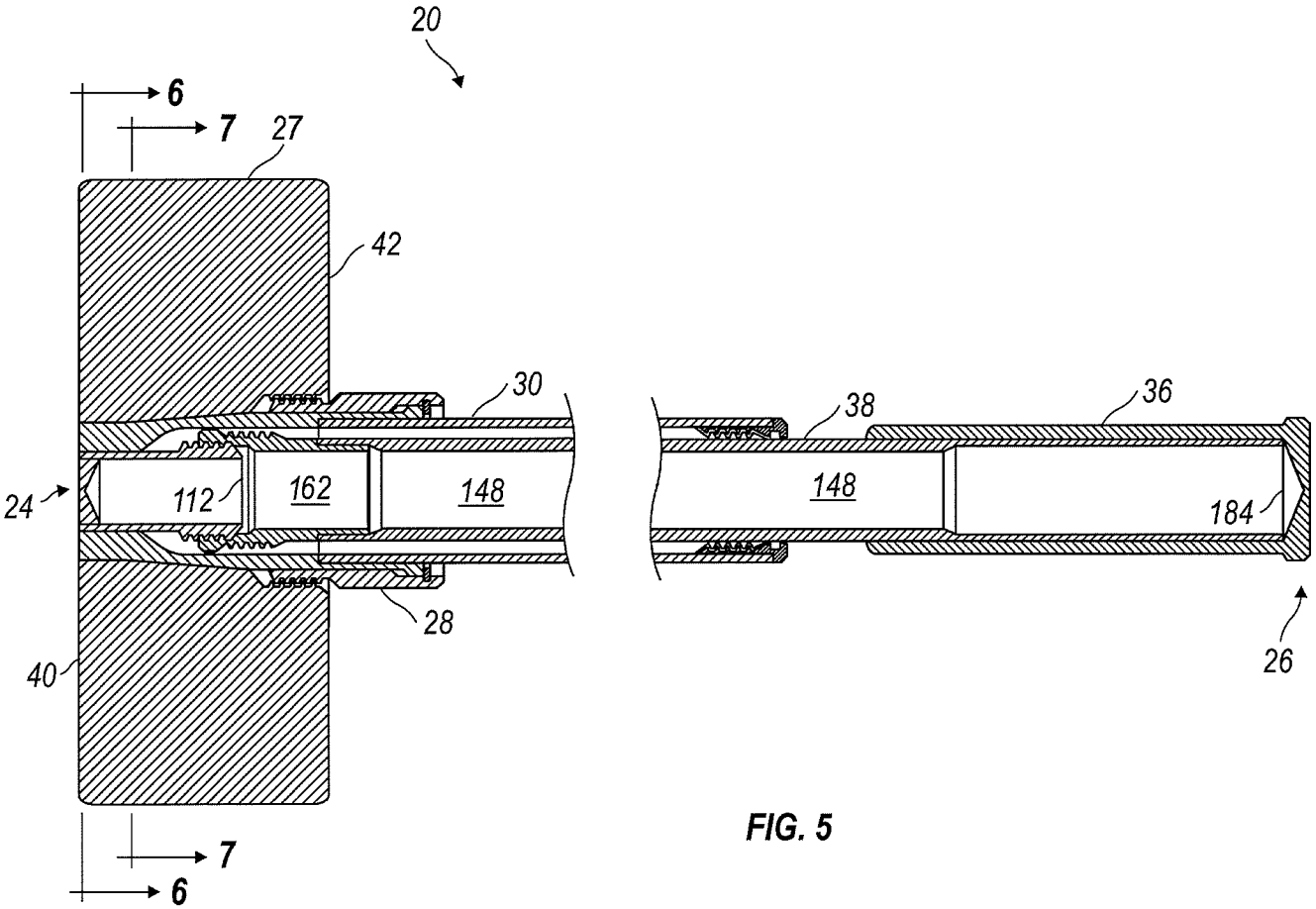
FIG. 5 is a side sectional view of the embodiment through plane 5-5 of FIG. 4.

Referring to FIGS. 4-5, which show the embodiment 20 in a compressed state, the male insert 162 is threadedly engaged with the handle hold 112. To move the embodiment 20 from the expanded state shown in FIG. 2 to the compressed state, the first handle tube 30 is rotated relative to the second handle tube 38. This causes rotation of the attached male insert 162 relative to the female insert 34 to disengage the inserts' respective threads 160, 170. After disengagement, the second handle tube 38 may be moved longitudinally into the first handle tube 30 until the inner thread 178 of the male insert 162 engage with the outer thread 128 of the handle hold 112. The slight taper of the partially-conical surface 104 of the lock adaptor 80 facilitates proper alignment of the male insert 162 with the handle hold 112.

Figure 6:
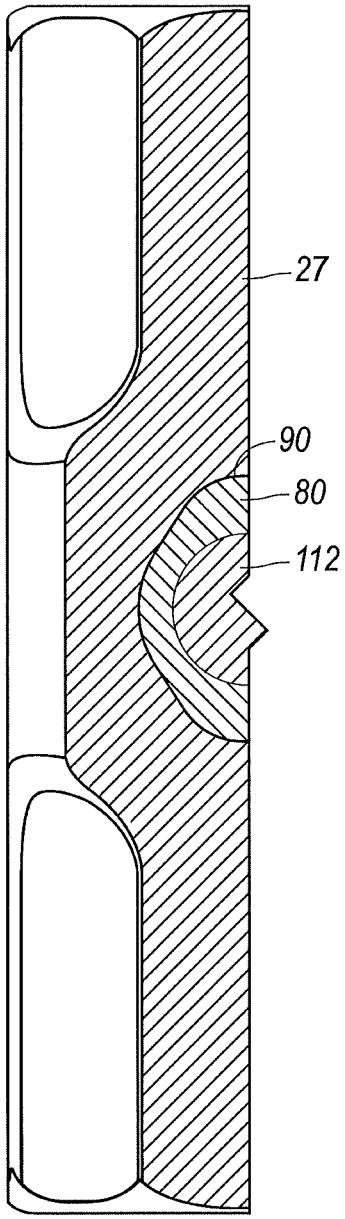
FIG. 6 is a sectional view through plane 6-6 of FIG. 5.
Figure 7:
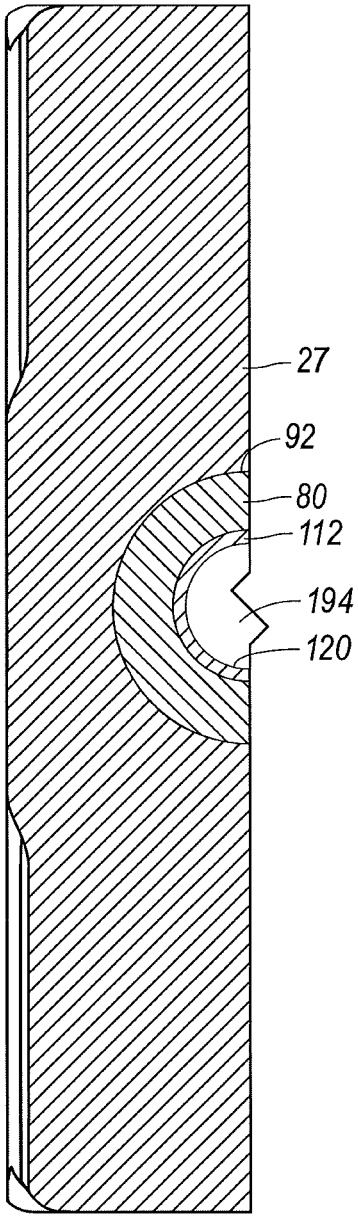
FIG. 7 is a section view through plane 7-7 of FIG. 5.

Referring to FIGS. 6-7, rotational movement of the head 27 relative to the lock adaptor 80 is inhibited by the non-circular outer surface 90 of the taper lock adaptor 80. The male insert 162 is inhibited from longitudinal movement relative to the female insert 34 due to threaded engagement therewith.

While the embodiment comprises a hammer head 27, alternative embodiments may include interchangeable heads, such as a fork head, a horn head, or a halligan head.

The present invention is described in terms of a preferred illustrative embodiment of a specifically-described apparatus. Those skilled in the art will recognize that alternative constructions of such a device can be used in carrying out the present invention. Other aspects, features, and advantages of the present invention may be obtained from a study of this disclosure and the drawings, along with the appended claims.

I claim:

1. A collapsible breaching tool comprising:

a tool head having a first side, a second side, and a passage extending within the tool head between the first side and the second side;

a handle hold at least partially within the passage, the handle hold having an outer thread;

a first handle tube having a first end, a second end, and defining a first handle tube volume, the first end within the passage;

a second handle tube having a first end, a second end, and a length;

a female insert at least partially within the first handle tube volume and connected to the second end of the first handle tube, the female insert having an inner thread; and a male insert connected to the first end of the second handle tube, the male insert having an inner thread engageable with the outer thread of the handle hold and having an outer thread engageable with the inner thread of the female insert.

2. The collapsible breaching tool of claim 1 wherein the second handle tube is moveable between a first position in which most of the length is outside the first handle tube volume and a second position in which most of the length is within the first handle tube volume.

3. The collapsible breaching tool of claim 1 further comprising a lock adaptor connected to the handle hold and the first end of the first handle tube.

4. The collapsible breaching tool of claim 3 further comprising a threaded section within the passage and a lock nut positioned around at least a portion of the lock adaptor, said lock nut having an outwardly threaded section enagageable with the threaded section of the passage.

5. The collapsible breaching tool of claim 4 wherein the lock nut is positioned around the first end of the first handle tube.

6. The collapsible breaching tool of claim 1 further comprising a threaded section within the passage and a lock nut positioned around at least a portion of the first handle tube, said lock nut having an outwardly threaded section enagageable with the threaded section of the passage.

7. The collapsible breaching tool of claim 1 wherein the handle hold is wholly within the passage.

8. The collapsible breaching tool of claim 1 wherein the inner thread of the male insert is engaged with the outer thread of the handle hold.

9. The collapsible breaching tool of claim 1 wherein the outer thread of the male insert is engaged with the inner thread of the female insert.

10. The collapsible breaching tool of claim 1 wherein the passage extends from the first side of the tool head to the second side of the tool head.

11. A collapsible breaching tool comprising:

a tool head having an opening into an interior space;

a handle hold at least partially within the interior space, the handle hold having an outer thread;

a first handle tube having a first end, a second end, and defining a first handle tube volume, the first end within the interior space;

a second handle tube having a first end, a second end, and a length;

a female insert at least partially within the first handle tube volume and connected to the second end of the first handle tube, the female insert having an inner thread; and a male insert connected to the first end of the second handle tube, the male insert having an inner thread engageable with the outer thread of the handle hold and having an outer thread engageable with the inner thread of the female insert.

12. The collapsible breaching tool of claim 11 further comprising a lock adaptor connected to the handle hold and the first end of the first handle tube.

13. The collapsible breaching tool of claim 12 further comprising a threaded section within the interior space and a lock nut positioned around at least a portion of the lock adaptor, said lock nut having an outwardly threaded section enagageable with the threaded section of the interior space.

14. The collapsible breaching tool of claim 13 wherein the lock nut is positioned around the first end of the first handle tube.

15. The collapsible breaching tool of claim 11 further comprising a threaded section within the interior space and a lock nut positioned around at least a portion of the first handle tube, said lock nut having an outwardly threaded section enagageable with the threaded section of the interior space.

16. The collapsible breaching tool of claim 11 wherein the handle hold is wholly within the interior space.

17. A collapsible breaching tool comprising:

a tool head;

a handle hold connected to the tool head, the handle hold having an outer thread;

a first handle tube having a first end, a second end, and defining a first handle tube volume;

a second handle tube having a first end, a second end, and a length;

a female insert at least partially within the first handle tube volume and connected to the second end of the first handle tube, the female insert having an inner thread; and a male insert connected to the first end of the second handle tube, the male insert having an inner thread engageable with the outer thread of the handle hold and having an outer thread engageable with the inner thread of the female insert.

18. The collapsible breaching tool of claim 17 wherein the handle hold is at least partially within the tool head.

19. The collapsible breaching tool of claim 18 wherein the handle hold is connected to the tool head through a lock adaptor within the tool head.

20. The collapsible breaching tool of claim 17 wherein the first end of the first handle tube is at least partially within the tool head.

* * * * *